United States Patent [19]

Mojica

[11] 4,071,917

[45] Feb. 7, 1978

[54] HAMMOCK HAVING CANOPY

[76] Inventor: Hector Mojica, 831 W. Lincoln Ave., Milwaukee, Wis. 53215

[21] Appl. No.: 676,110

[22] Filed: Apr. 12, 1976

[51] Int. Cl.[2] ..... A47K 11/02; E04F 10/00

[52] U.S. Cl. ..... 5/121; 5/128; 135/8

[58] Field of Search ..... 5/121, 128; 135/8

[56] References Cited

U.S. PATENT DOCUMENTS

| | | | |
|---|---|---|---|
| 41,418 | 2/1864 | Abbott | 5/122 |
| 273,388 | 3/1883 | Pratt | 5/122 |
| 495,532 | 4/1893 | Travers | 5/121 |
| 646,622 | 4/1900 | Donavin | 5/122 |
| 866,322 | 9/1907 | Barratt | 5/122 |
| 1,116,074 | 11/1914 | Jones | 5/121 |
| 1,401,846 | 12/1921 | Wiles | 5/121 |
| 2,375,792 | 5/1945 | Kearny | 5/121 |

FOREIGN PATENT DOCUMENTS

| | | | |
|---|---|---|---|
| 72,199 | 2/1959 | Denmark | 5/122 |
| 487,858 | 8/1918 | France | 5/121 |

*Primary Examiner*—Philip Kannan

*Attorney, Agent, or Firm*—Andrus, Sceales, Starke & Sawall

[57] ABSTRACT

A hammock includes a bed formed of a supporting sheet gathered at each end and suitable for joinder to spaced anchors. A second sheet forms a canopy over the bed. One side of the canopy is joined to a side of the supporting sheet. The medial portion of the second sheet is supported above the bed by a rope between the anchors. The other side of the second sheet forms an extendable fly for providing additional shelter. A net extends between the medial portion of the second sheet and the other side of the bed. They are joined by a zipper for permitting access to the hammock.

9 Claims, 4 Drawing Figures

HAMMOCK HAVING CANOPY

BACKGROUND OF THE INVENTION

1. Field of the Invention

The present invention relates to a hammock having a protective canopy.

2. Description of the Prior Art

Camping, even of the minimum equipment-backpacking type, requires some form of shelter for sleeping, protection from inclement weather, and equipment storage. Heretofore this shelter has most often been a tent and many small, lightweight tents suitable for backpacking have been developed.

However, tents require a flat, smooth area for pitching. This is not always available. Clearing a site to pitch a tent may cause ecological damage through the destruction of small plants or saplings. Tents are also prone to flooding in rain storms and difficult to pitch in the winter.

Hammocks provide a bed for a camper which does not require a flat smooth area and may be used in the winter. However, unless provided with a canopy they provide little protection to the camper and usually no protection to his equipment.

Canopied hammocks in the past have employed frames which so increase the bulk and weight of the equipment as to lessen or preclude its use for backpacking. The design of these hammocks, particularly in the use of a plurality of grommets at each end, necessitates a heavy weight fabric. Further, in many cases, such canopies consisted only of mosquito netting or netting plus a roof and did not provide adequate shelter to the camper or his equipment.

SUMMARY OF THE PRESENT INVENTION

It is, therefore, the object of the present invention to provide an improved hammock having a canopy. The hammock is sufficiently light and compact as to permit use in backpacking and provides a high degree of protection both to the camper and his equipment. The hammock may be quickly and easily set up. The hammock provides a high degree of protection against the weather, particularly rain or snow.

The hammock is so constructed as to permit its use in a tent-like manner in areas where suitable anchors are not present. When used as a hammock, it reduces or eliminates body aches or fatigue arising from sleeping on the ground. It also reduces compression of the goose down or fiberfill clothing or sleeping bag under the greater portion of the body by concentrating such compression in the lower back or buttocks area.

The bed of the hammock is formed of a single sheet of material gathered at the ends and joinable to spaced anchors such as trees. A second sheet is formed into a canopy for the bed. One side of the second sheet is joined to one of the sides of the bed. The medial portion of the canopy sheet is supported above the bed as by attachment means fastened to a rope extending between the trees above the bed. The free side of the sheet is formable into a fly. Guys are attached to the corners of the free side of the sheet. A net extends from the medial portion of the canopy and is joined through a zipper to the other side of the bed.

DETAILED DESCRIPTION OF THE PREFERRED EMBODIMENT

Figure 1:
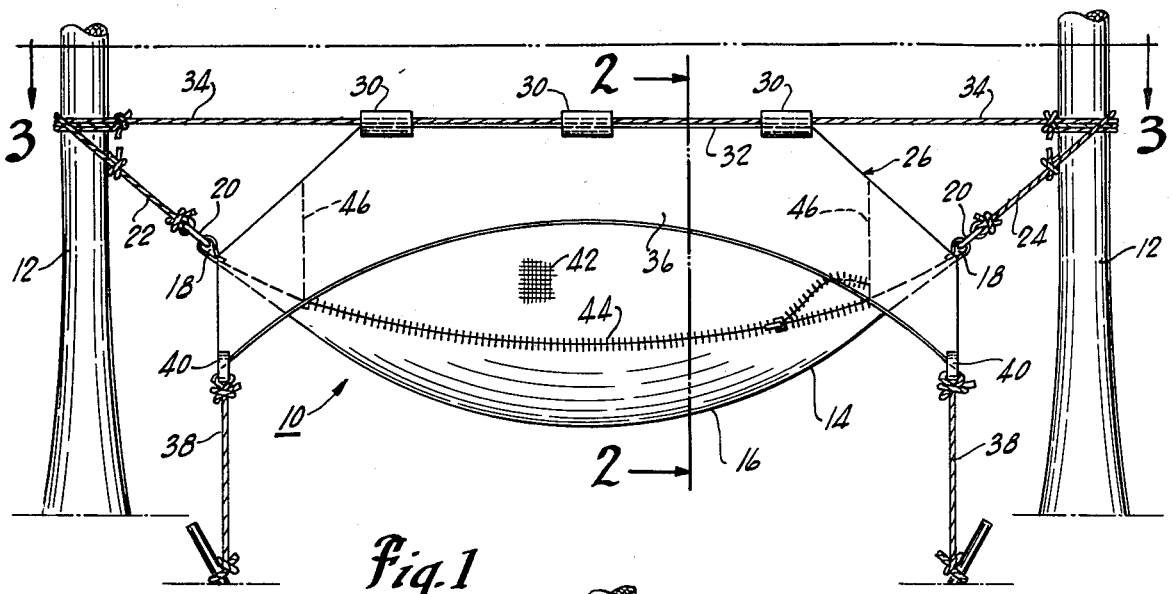
FIG. 1 is an elevational view of the improved hammock of the present invention.

Turning now to the Figures, there is shown in FIG. 1, hammock 10 of the present invention. Hammock 10 is designed to be suspended between two spaced anchors, exemplary shown as trees 12.

Figure 2:
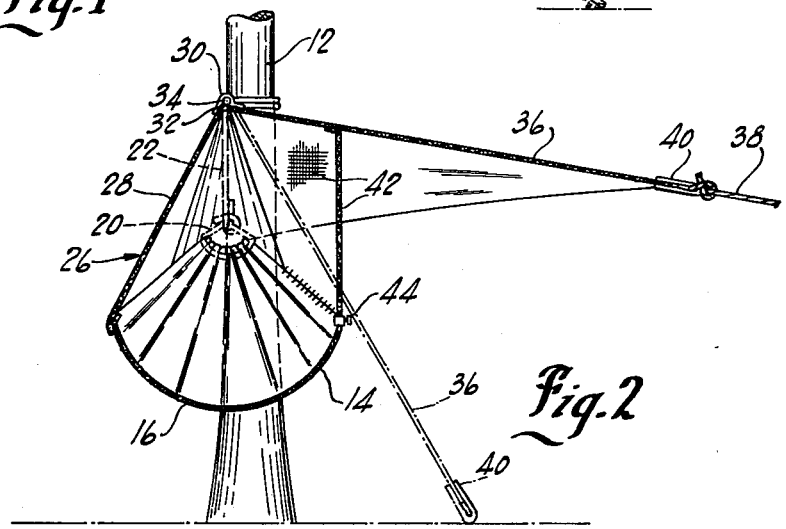
FIG. 2 is a cross-sectional view taken along the line 2—2 of FIG. 1.
Figure 3:
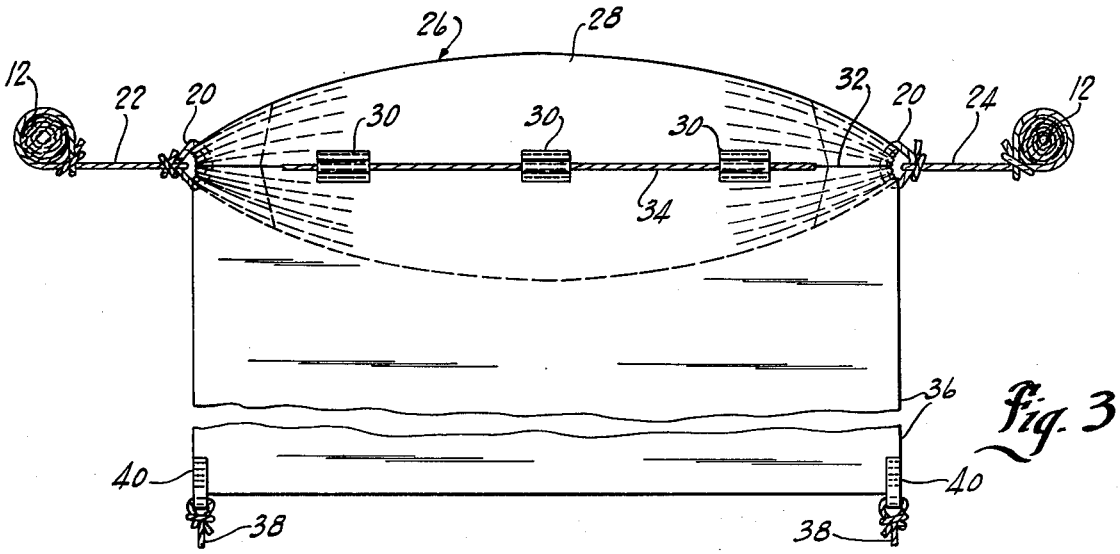
FIG. 3 is a plan view of the improved hammock of the present invention.

Hammock 10 includes bed 14 suitable for supporting a reclining person. Bed 14 is formed of a rectangular sheet of weatherproof fabric 16 best shown in FIG. 4. Light weight fabric, for example, polymer coated nylon pack cloth may be used for sheet 16. The ends of sheet 16 are folded back and sewn to form tunnel 18 across each end of sheet 16. A short length of rope 20 is passed through tunnel 18 and tied into a loop, bunching the ends of sheet 16, as shown in FIGS. 2 and 3. This bunching enhances the strength of fabric 16 in supporting the user of hammock 10 and permits use of light weight material for bed 14. The loops formed of ropes 20 receive one end of ropes 22 and 24. The other end of ropes 22 and 24 may be fastened to trees 12. The sheet forming bed 14 may be sized so that the length of the sheet available to receive the body of the user is approximately 84 inches.

Figure 4:
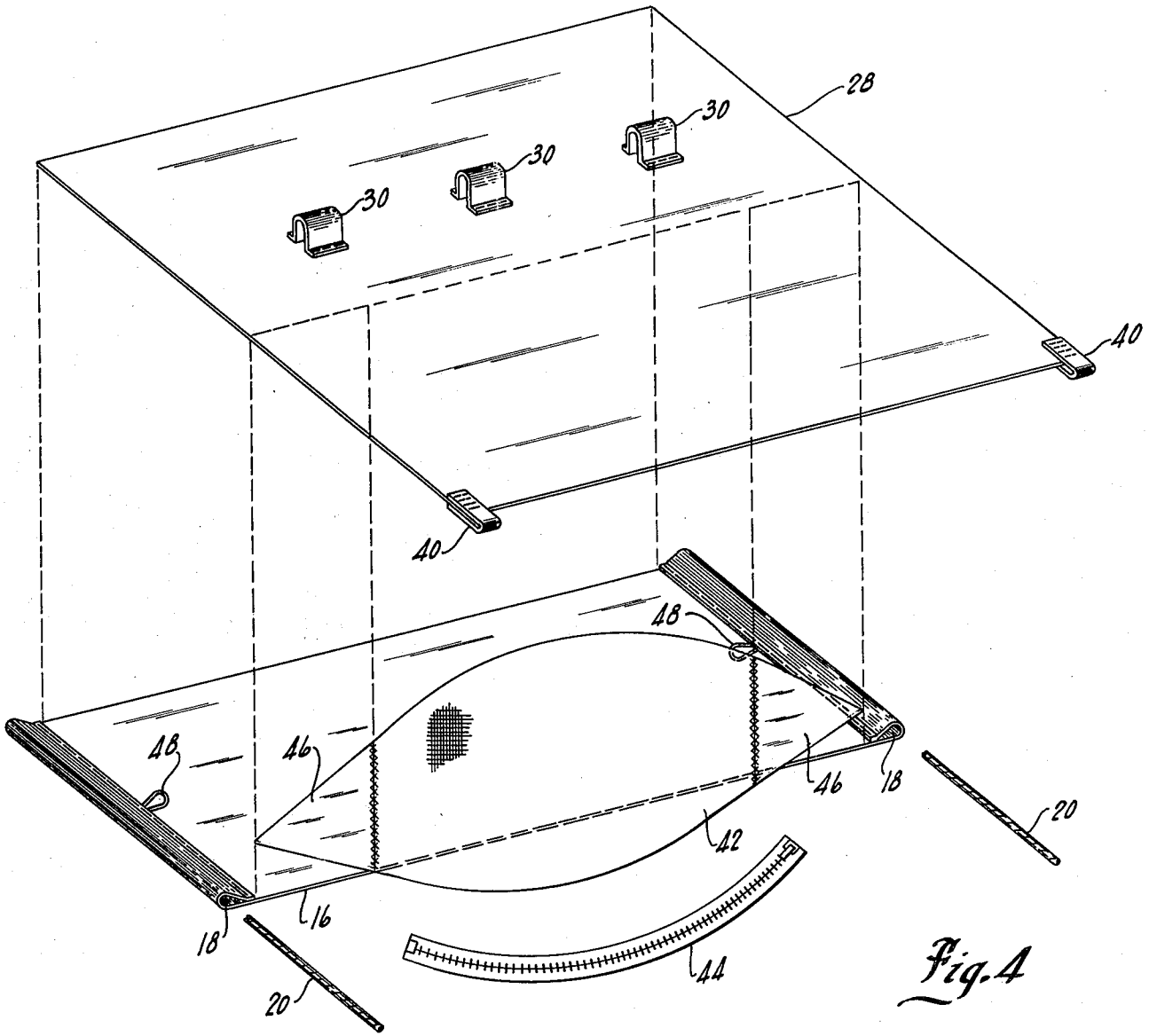
FIG. 4 is an exploded perspective view of the various portions of the improved hammock of the present invention.

A canopy 26 is provided for bed 14. Canopy 26 is formed of a second sheet 28 of light weight weather proof fabric, for example polymer coated nylon. The length of sheet 28 may approximate that of sheet 16 while the width may be twice as great, as shown in FIG. 4. One side of sheet 28 is affixed to one of the longitudinal sides of sheet 16 forming bed 14 as shown in FIGS. 2 and 3. Sheet 26 slants upwardly therefrom toward a point over the center of bed 14, as best shown in FIG. 2. The medial portion of sheet 28 above the center of bed 14 contains a plurality of loops 30, ties or snaps suitable for being affixed to rope or elastic shock cord 34 stretched between trees 12. A ridge 32 is thus formed in canopy 26 up to 42 inches above the center of bed 14 at the lowest point of the catenary of bed 14.

The other side of sheet 28 beyond ridge 32 extends past the edge of bed 14 and may be formed into a fly 36. Guys 38 are fastened to loops 40 at the corners of sheet 28 and staked to the ground. In the event of rain, fly 36 provides shelter for equipment storage or for activities such as cooking.

Also as shown in FIG. 2, netting 42 extends from the medial portion of sheet 28 to the other longitudinal side of sheet 16 forming bed 14. The upper edge of net 42 is sewn to the medial portion of sheet 28. The lower edge of net 42 contains a zipper 44 by which the netting may be selectively joined to bed 14. The upper and lower edges of net 42 are curved to provide a somewhat oval shape to the net which accomodates the catenary in bed 14. Gussets 46 may be provided at either end of net 42 to complete the closure of this side of hammock 10.

While fly 36 is shown in the extended position in FIG. 2, it will be appreciated that it may be staked to the ground adjacent hammock 10 as shown in phantom in FIG. 2 so as to provide greater protection to the user in inclement or cold weather.

Clothing and other small personal items which must be protected from the weather may be stored inside the hammock in the ends beyond the head and feet of the user. This also serves to remove creases in the canopy which might otherwise collect moisture. Rope or cloth loops 48 may be provided at each end of sheet 16 to secure these items.

A hammock constructed as shown above weighs approximately 3 pounds and stores compactly in a 14 inch long by 4 inch in diameter roll.

In areas where the trees are not large enough to suspend the present invention in a hammock configuration, it may be used as a tent. Ropes 20 are untied and supporting sheet 16 spread out flat as displayed in FIG. 4. Rope 34 for raising canopy 26 is tied to available underbrush to position the canopy over the bed.

Various modes of carrying out the invention are contemplated as being within the scope of the following claims particularly pointing out and distinctly claiming the subject matter which is regarded as the invention.

I claim:

1. A hammock comprising:

a rectangular sheet of fabric suitable for supporting a person in the reclining position, said sheet having a first dimension extending between ends of said sheet and a second dimension transverse to, and shorter than, said first dimension, said second dimension extending between sides of said sheet, said supporting sheet being gathered at each of said ends and joinable to ropes for suspending the sheet between spaced anchors;

a canopy over said supporting sheet, said canopy comprising a second sheet of waterproof fabric material, said second sheet having a first dimension extending between ends of said sheet and approximating that of said supporting sheet and a second, transverse dimension exceeding the second dimension of said supporting sheet, said second dimension extending between sides of said second sheet, said second sheet having portions of its ends fastened to said ends of said supporting sheet and similarly gathered, one entire side of said second sheet being attached to one entire side of said supporting sheet, said second sheet having a medial portion supportable above the center of said supporting sheet, and the free side of said second sheet formable, with the portions of said ends of said second sheet not fastened to said ends of said supporting sheet, into an extendable fly; and netting joined to said medial portion of said second sheet and selectively joinable to the unattached side of said supporting sheet for permitting access to the hammock.

2. The hammock according to claim 1 wherein both of said sheets are formed of a generally weatherproof fabric.

3. The hammock according to claim 1 wherein said medial portion contains attachment means connectable to a rope means affixed to the anchors above said supporting sheet for positioning said medial portion over said supporting sheet.

4. The hammock according to claim 1 wherein a zipper is interposed between said netting and the unattached side of said supporting sheet.

5. The hammock according to claim 1 wherein the joinder of the net to said medial portion is located so that the net hangs approximately vertically when said fly is extended.

6. The hammock according to claim 1 wherein said supporting sheet is formed to have a transverse tube at each end for receiving a loop for gathering said end and joinable to a rope.

7. The hammock according to claim 1 wherein sides of said netting joined to said supporting and second sheet are curved.

8. The hammock according to claim 7 including gussets at either end of said netting joined to said netting and sheets.

9. The hammock according to claim 7 wherein a zipper is interposed between said netting and the unattached side of said supporting sheet.

* * * * *